US010968668B2

(12) United States Patent
Gruber et al.

(10) Patent No.: US 10,968,668 B2
(45) Date of Patent: Apr. 6, 2021

(54) VEHICLE DOOR CHECKER

(71) Applicant: Multimatic Inc., Markham (CA)

(72) Inventors: Rudolf Gruber, Uxbridge (CA); David Edward Carswell, Aurora (CA)

(73) Assignee: Multimatic Inc., Markham (CA)

( * ) Notice: Subject to any disclaimer, the term of this patent is extended or adjusted under 35 U.S.C. 154(b) by 0 days.

(21) Appl. No.: 16/539,662

(22) Filed: Aug. 13, 2019

(65) Prior Publication Data

US 2019/0368243 A1 Dec. 5, 2019

Related U.S. Application Data

(63) Continuation-in-part of application No. 15/524,407, filed as application No. PCT/US2015/059495 on Nov. 6, 2015, now Pat. No. 10,570,653.

(51) Int. Cl.
*E05C 17/20* (2006.01)

(52) U.S. Cl.
CPC ..... *E05C 17/203* (2013.01); *E05Y 2900/531* (2013.01)

(58) Field of Classification Search
CPC . E05C 17/203; E05Y 2900/531; Y10T 16/61; Y10T 16/6295; Y10T 16/625
See application file for complete search history.

(56) References Cited

U.S. PATENT DOCUMENTS 4,833,755 A 5/1989 Bonin
5,862,570 A * 1/1999 Lezuch ..... E05C 17/085 16/82

(Continued)

FOREIGN PATENT DOCUMENTS

AT 350403 B 5/1979
CN 201184083 Y 1/2009

(Continued)

OTHER PUBLICATIONS

Indian Examination Report for Indian Application No. 201817006207 dated Dec. 4, 2019.

(Continued)

*Primary Examiner* — Victor D Batson
*Assistant Examiner* — Matthew J Sullivan
(74) *Attorney, Agent, or Firm* — Carlson, Gaskey & Olds, P.C.

(57) ABSTRACT

A door checker includes a housing which has a base from which first and second opposing flanges extend. First and second guide pins are spaced apart from one another and are interconnected to the first and second flanges. The first and second guide pins are configured to deflect in response to a load. A check arm extends through the base and is arranged between the first and second guide pins. The check arm is configured to move relative to the housing and includes a profile that corresponds to a variable door holding force. A bearing member is arranged on one side of the check arm and the bearing member coacts with the profile and is supported on the first and second guide pins and is configured to slide thereon in response to movement of the check arm relative to the bearing member. The bearing member transfers the load from the check arm to the first and second guide pins.

18 Claims, 8 Drawing Sheets

(56) References Cited

U.S. PATENT DOCUMENTS

| | | | | |
|---|---|---|---|---|
| 7,076,833 | B2 * | 7/2006 | Murayama | E05C 17/203 16/82 |
| 7,469,944 | B2 * | 12/2008 | Kitayama | E05C 17/203 16/86 A |
| 7,908,709 | B2 * | 3/2011 | Cruz | E05C 17/203 16/86 B |
| 9,003,604 | B2 * | 4/2015 | Matsuki | E05F 5/025 16/86 C |
| 9,346,341 | B2 * | 5/2016 | Ziegler | E05C 17/203 |
| 2004/0075285 | A1 * | 4/2004 | Murayama | E05C 17/203 292/265 |
| 2006/0267354 | A1 * | 11/2006 | Petrus Van Den Heuvel | E05C 17/203 292/262 |
| 2008/0209675 | A1 | 9/2008 | Sempert et al. | |
| 2010/0154163 | A1 * | 6/2010 | Hoffmann | E05C 17/203 16/85 |
| 2018/0283061 | A1 | 10/2018 | Gruber et al. | |
| 2019/0010741 | A1 * | 1/2019 | Youn | E05C 17/203 |
| 2019/0112849 | A1 | 4/2019 | Cumbo | |

FOREIGN PATENT DOCUMENTS

| | | | | |
|---|---|---|---|---|
| CN | 103737665 | A | 4/2014 | |
| CN | 204002171 | U | 12/2014 | |
| DE | 4325550 | C2 | 3/2003 | |
| DE | 102004034259 | A1 | 2/2005 | |
| DE | 202011051957 | U1 | 1/2012 | |
| DE | 202016104014 | U1 * | 9/2016 | E05C 17/203 |
| DE | 202016104014 | U1 | 9/2016 | |
| EP | 0165693 | A2 | 12/1985 | |
| EP | 2682547 | A1 | 1/2014 | |
| FR | 849440 | A | 11/1939 | |
| FR | 2957110 | A1 | 2/2012 | |
| JP | 2581536 | Y2 | 9/1998 | |
| JP | 2001012127 | A | 1/2001 | |
| JP | 2002129818 | A | 5/2002 | |
| JP | 2004-44187 | A | 2/2004 | |
| JP | 2006-97402 | A | 4/2006 | |
| JP | 2006291672 | A | 10/2006 | |
| JP | 2007239339 | A | 9/2007 | |
| JP | 2014-34865 | A | 2/2014 | |
| JP | 2014-214487 | A | 11/2014 | |
| JP | 2014234699 | A | 12/2014 | |
| KR | 100901313 | B1 | 6/2009 | |
| KR | 1020110089474 | A | 8/2011 | |
| KR | 1020130042407 | A | 4/2013 | |
| KR | 20140089085 | A | 7/2014 | |
| WO | 2006049540 | A1 | 5/2006 | |

OTHER PUBLICATIONS

International Search Report and Written Opinion for PCT/ US2015/059495 dated Aug. 29, 2016.

Japanese Office Action for Japanese Application No. 2018-521387 dated Apr. 2, 2019.

International Preliminary Report on Patentability for International Application No. PCT/US2015/059495 dated May 17, 2018.

Russian Search Report for Russian Application No. 2018120493 completed Oct. 18, 2018.

European Search Report for European Application No. 20188093.7 dated Jan. 22, 2021.

* cited by examiner

VEHICLE DOOR CHECKER

CROSS-REFERENCE TO RELATED APPLICATIONS

The present disclosure is a Continuation-In-Part of U.S. application Ser. No. 15/524,407, filed May 4, 2017, which is a United States National Phase Application of PCT Application No. PCT/US2015/059495, filed Nov. 6, 2015, and is incorporated herein by reference in its entirety.

BACKGROUND

This disclosure relates to a door checker used for automotive vehicle doors.

A door checker is commonly used in an automotive vehicle to hold a door in one of several discrete open positions. The door checker housing is mounted within a door cavity, and a check arm extends through the housing and attaches at one end to a vehicle pillar. The check arm includes a profile with a groove that has a variable height and several spaced apart pockets that correspond to the discrete open positions. A pair of spring loaded balls is arranged within the housing and cooperates with opposing sides of the check arm to provide a desired lateral and longitudinal holding force on the check arm.

In one prior art arrangement, the housing is provided by two stamped sheet metal housing portions that are secured to one another to provide a six-sided box-like structure enclosing the balls and springs. This configuration has been widely used and provides a robust door checker design, but is relatively heavy.

SUMMARY

In one exemplary embodiment, a door checker includes a housing which has a base from which first and second opposing flanges extend. First and second guide pins are spaced apart from one another and are interconnected to the first and second flanges. The first and second guide pins are configured to deflect in response to a load. A check arm extends through the base and is arranged between the first and second guide pins. The check arm is configured to move relative to the housing and includes a profile that corresponds to a variable door holding force. A bearing member is arranged on one side of the check arm and the bearing member coacts with the profile and is supported on the first and second guide pins and is configured to slide thereon in response to movement of the check arm relative to the bearing member. The bearing member transfers the load from the check arm to the first and second guide pins.

In a further embodiment of the above, a portion of the bearing member selectively engages the check arm based upon a sliding position of the check arm relative to the housing.

In a further embodiment of any of the above, the variable holding force is a first variable door holding force. The portions provided by lateral sides define a width that varies along a length of the check arm. A second variable door holding force is provided between the bearing member and the lateral sides based upon a position along the length.

In a further embodiment of any of the above, the bearing member includes a bearing case that has first and second sleeves that respectively receive the first and second guide pins. The sleeves extend to a region adjacent to the lateral sides. The first and second sleeves are spaced from the lateral sides with the check arm in a position corresponding to a first position. The sleeves engage the lateral sides and deflect the first and second guide pins with the check arm in a position corresponding to a second position to generate the load.

In a further embodiment of any of the above, the sleeves engage the first and second lateral sides and deflect the first and second guide pins with the check arm in another position that is different than the second position. The check arm deflects the first and second guide pins such that the load is a first load in the second position. The check arm deflects the first and second guide pins such that the load is a second load in the other position that is different than the first load.

In a further embodiment of any of the above, each of the first and second sleeves includes first and second elongated slots respectively along their lengths. The first and second slots respectively receive the first and second guide pins. The first and second slots have an arcuate cross-section and are open on one side.

In a further embodiment of any of the above, the door checker includes another bearing member that is arranged on another side of the check arm. The other bearing member coacts with another profile on the other side of the check arm. The profiles have a variable height. The bearing members are configured to slide along the first and second guide pins as the bearing members coact with the profiles.

In a further embodiment of any of the above, the bearing member includes a bearing case with an aperture within which a ball is arranged. The ball engages the profile. A spring is arranged between the first flange and the bearing case and is configured to urge the ball into engagement with the profile to provide the variable door holding force.

In a further embodiment of any of the above, the bearing case is configured to slide on the first and second guide pins as the ball slides in the groove.

In a further embodiment of any of the above, the bearing member includes a bearing case slidable on the first and second guide pins during operation and includes a clevis pivotally attached to one end of the check arm. A stop is provided at the other end of the check arm on a side of the bearing case with an outer face that has spaced apart protrusions that are configured to laterally locate the stop with the check arm in a fully extended position. The bearing case includes an inner face spaced from the base in a first position. The guide pins are configured to flex thereby transferring the load and to permit the inner face to engage the base in another position in which the stop engages the outer face.

In a further embodiment of any of the above, the base includes spaced apart lips. The bearing case includes opposing edges that adjoin the inner face near the lips. The lips are configured to arrest lateral motion of the bearing case with respect to the housing in the other position.

In a further embodiment of any of the above, each of the first and second guide pins includes swaged ends that secure the first and second guide pins to the first and second flanges.

In a further embodiment of any of the above, the housing is plastic.

In another exemplary embodiment, a method of holding a door in a desired open position includes the steps of sliding a check arm relative to a bearing member to provide a first variable door holding force, sliding the bearing member along a guide pin in response to the check arm sliding step, and engaging the check arm with a portion of the bearing member in response to the check arm sliding step to provide a second variable door holding force in addition to the first variable door holding force.

In a further embodiment of any of the above, a portion of the bearing member selectively engages the check arm during the check arm sliding step, the portion spaced from the check arm at a first check arm position, and the portion engaging the check arm at a second check arm position.

In a further embodiment of any of the above, the guide pin is a first guide pin and includes a second guide pin. The check arm includes lateral sides. The portion is provided by first and second sleeves that are slidably supported on the first and second guide pins. The bearing member transfers a load from the check arm to the first and second guide pins during the check arm engaging step. The load corresponds to the second variable door holding force.

In a further embodiment of any of the above, the check arm is arranged between a pair of bearing members. The bearing members move relative to one another during the check arm sliding step.

In a further embodiment of any of the above, the bearing member includes a bearing case that has a ball that rides along a groove in the check arm that provides a profile.

In a further embodiment of any of the above, the method includes a housing that supports a pair of guide pins that support the bearing case for sliding movement in response to the check arm sliding step.

In a further embodiment of any of the above, the method includes the step of engaging the bearing case with a check arm stop which deflects the guide pin and moves the bearing case into engagement with the housing.

BRIEF DESCRIPTION OF THE DRAWINGS

The disclosure can be further understood by reference to the following detailed description when considered in connection with the accompanying drawings wherein.

Figure 1:
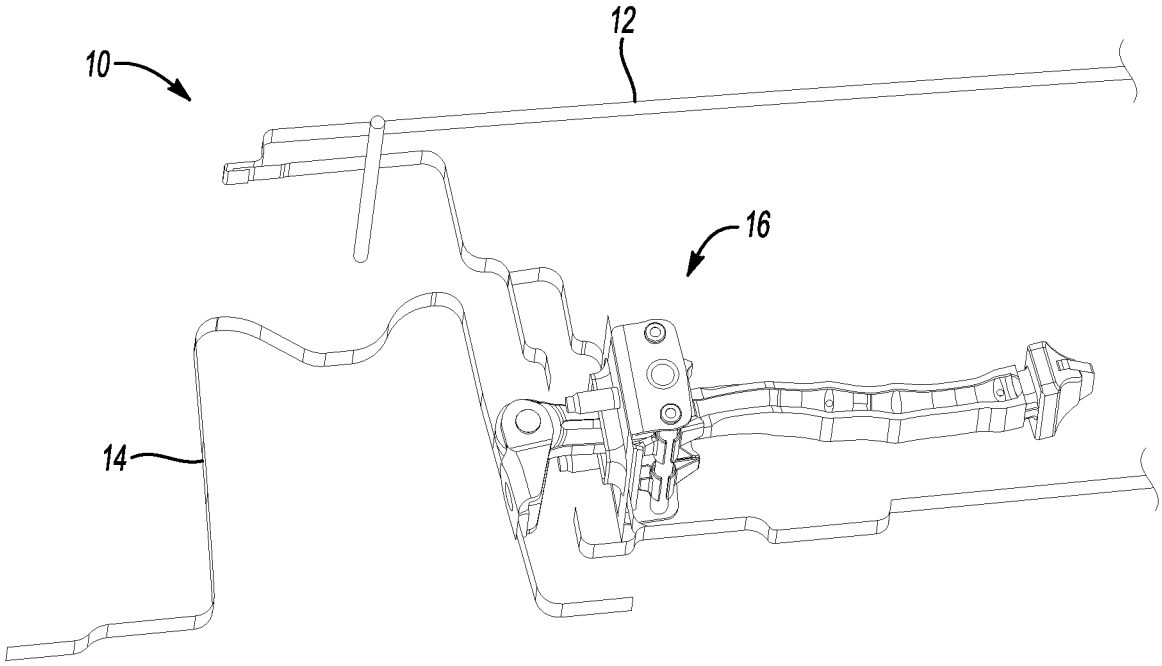
FIG. 1 is a perspective view of a door check arranged within a door cavity and secured to a vehicle pillar.

The embodiments, examples and alternatives of the preceding paragraphs, the claims, or the following description and drawings, including any of their various aspects or respective individual features, may be taken independently or in any combination. Like reference numerals are used to indicate like elements. Features described in connection with one embodiment are applicable to all embodiments, unless such features are incompatible.

DETAILED DESCRIPTION

A portion of a vehicle 10 is illustrated in FIG. 1. The vehicle 10 includes a door 12 adjacent to a pillar 14 that provides a door opening. A door checker 16 is arranged within a door cavity and is interconnected between the door 12 and pillar 14. The door checker 16 provides discrete open positions in which the door is maintained in a desired open position by a holding force provided by the door checker.

Figure 2A:
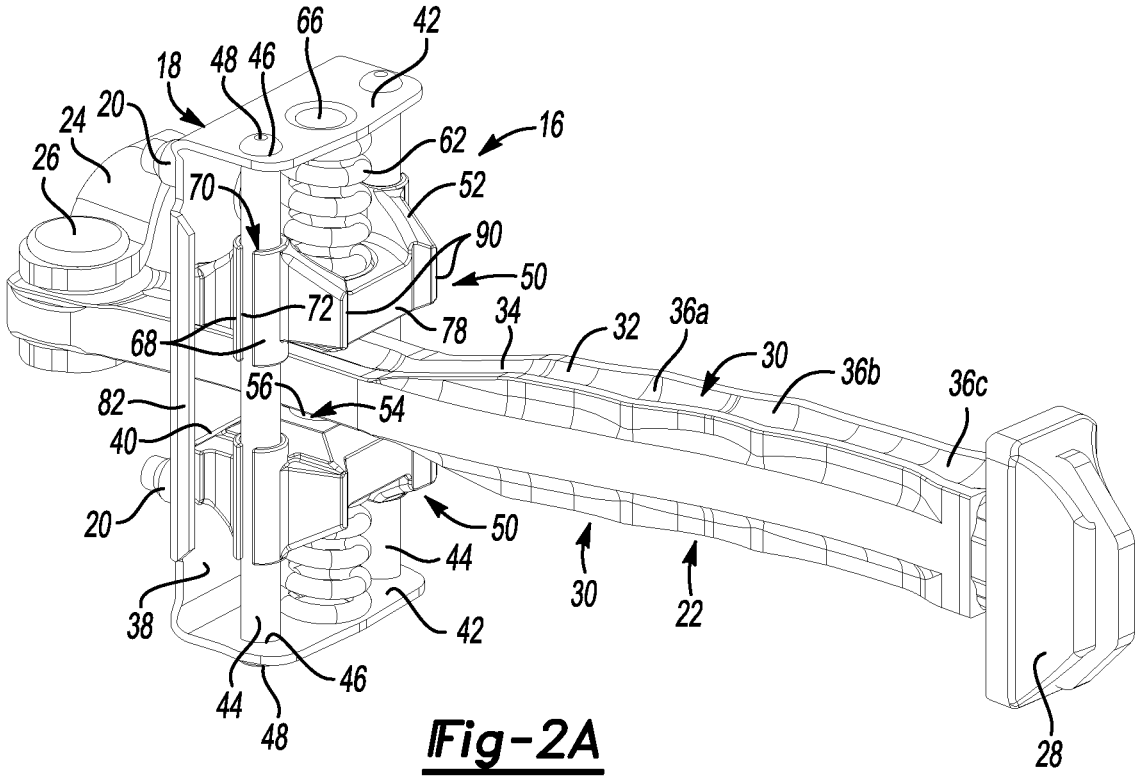
FIG. 2A is an enlarged perspective view of the door checker shown in FIG. 1.
Figure 2B:
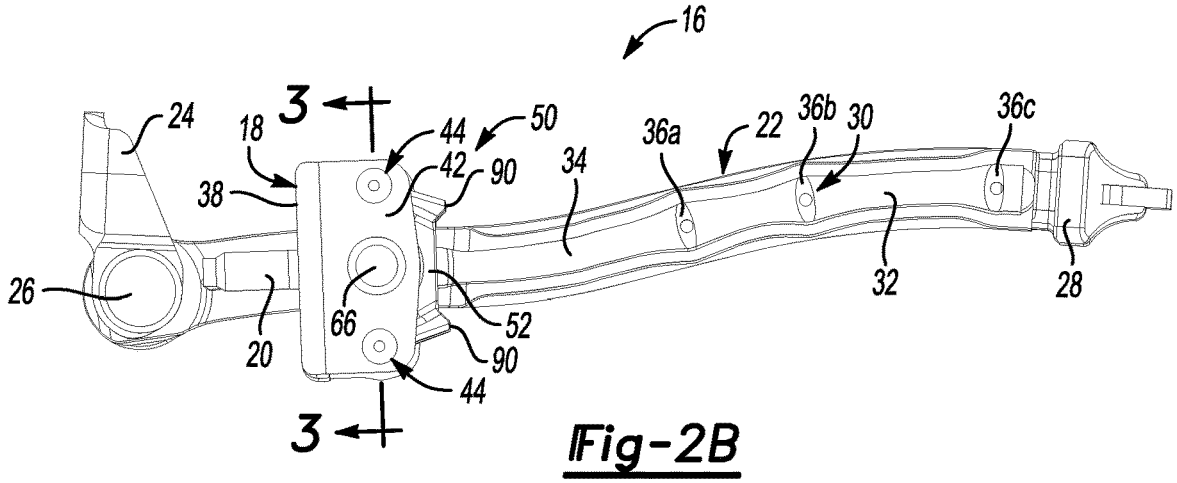
FIG. 2B is a plan view of the door checker shown in FIG. 2A.
Figure 2C:
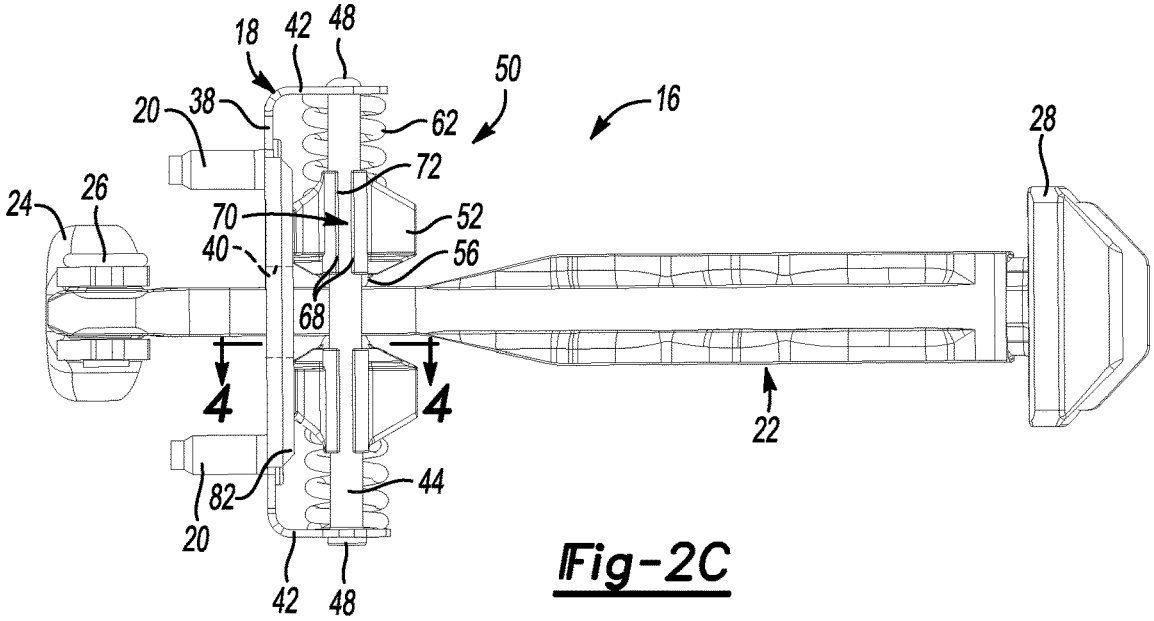
FIG. 2C is side elevational view of the door checker shown in FIG. 2A.

Referring to FIGS. 2A-2C, the door checker 16 includes a stamped sheet metal C-shaped housing 18 that is substantially open on three sides. Fasteners 20, for example, studs, are mounted to the housing 18 and used to secure the door checker 16 to the door 12 with nuts. A check arm 22 extends through the housing 18 and includes a clevis 24 secured to one end by a pivot pin 26. The clevis 24 is secured to the pillar 14. A stop 28 is provided at an end of the check arm 22 opposite the clevis 24 to limit the range of motion when the door is opened.

In the example illustrated, the check arm 22 is a plastic material overmolded about a metal core. The check arm 22 includes a profile 30 arranged on each of opposing sides and is provided by a groove 32. The groove 32 includes a ramp 34 that increases the spring pre-load as the door 12 is opened. Multiple pockets 36*a*, 36*b*, 36*c* are provided in the groove 32 and correspond to discrete door open positions at a predetermined holding force.

The housing 18 includes a base 38 having an opening 40 through which the check arm 22 extends. Opposing flanges 42 are integral with and extend from the base 38 in the illustrated embodiment. A guide element, such as a pair of guide pins 44, are interconnected to the flanges 42 and spaced from the base 38. In the example, the guide pins 44 extend through holes 46 in the flanges 42 and are retained to the housing 18 by enlarged ends 48, one end of which may be swaged during assembly.

Figure 3:
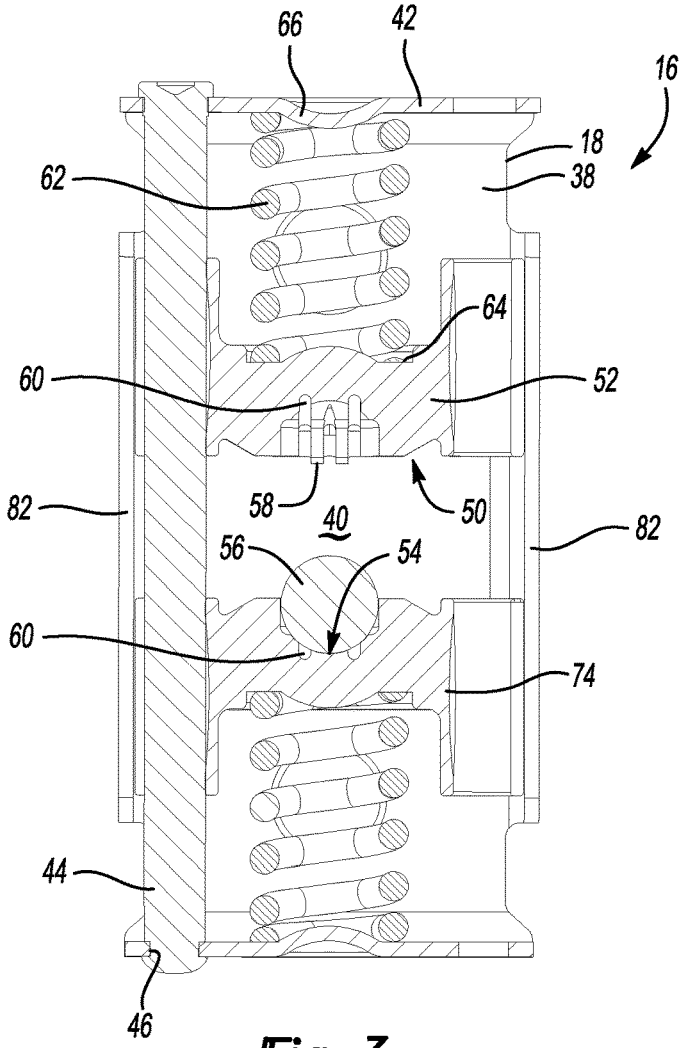
FIG. 3 is a cross-sectional view taken along line 3-3 in FIG. 2B.
Figure 4:
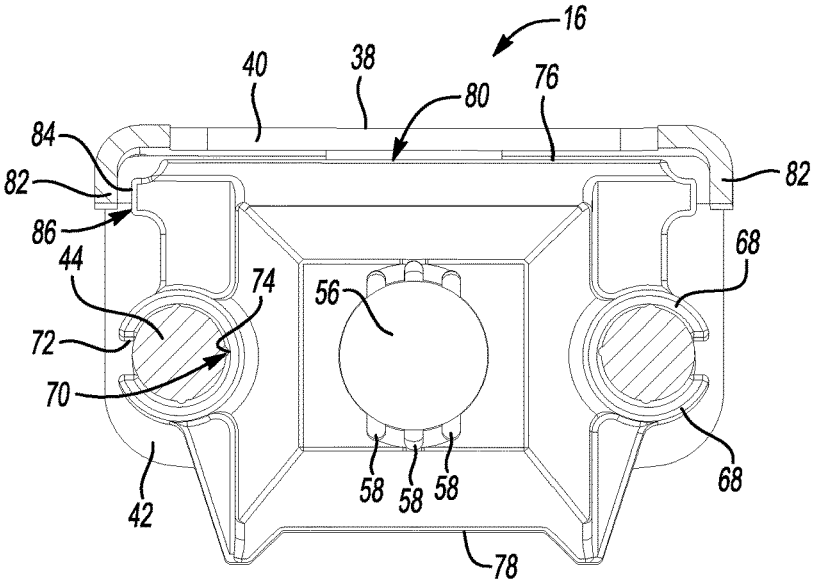
FIG. 4 is a cross-sectional view taken along line 4-4 in FIG. 2C.

Referring to FIGS. 3 and 4, a bearing member 50 is provided between each flange 42 and the check arm 22 to exert the holding force on the groove 32. In the example, each bearing member 50 is provided by a plastic bearing case 52 that has an aperture 54 which receives a metallic ball 56. The bearing case 52 includes tabs 58 at a perimeter of the aperture 54 that provide an opening that is slightly smaller than a diameter of the ball 56, shown in FIGS. 3 and 4. Thus, the tabs 58 retain the balls 56 in their respective apertures 54 during assembly. One or more slots 60 are provided in the apertures 54 and are filled with a lubricant to lubricate the balls 56 during use.

A spring 62 is mounted between each flange 42 and each bearing case 52. In the example, the bearing cases 52 include a recess 64, and the flange 42 provides a dimple 66. The recess 64 and dimple 66 locate and retain the position of the spring 62 during operation.

Each opposing end of the bearing cases 52 includes curved walls 68 providing an arcuate elongated slot 70 having a C-shaped cross section, best shown in FIG. 4. The elongated slot 70 has a diameter that is slightly smaller than an outer diameter of the guide pins 44. The elongated slot 70 includes an opening 72 that enables the curved walls 68 to flex and accommodate the guide pin 44 during assembly, which provides elastic tolerance compensation and prevents noise by eliminating free play. Referring to FIGS. 3 and 4, one or more pockets 74 may be provided in the elongated slot 70 and filled with lubricant. The pockets 74 are disposed interiorly of the edges of the elongated slot 70 to better retain the lubricant.

Each ball 56 is positioned within its respective groove 32 on opposing sides of the check arm 22. When the door is opened and closed during use, the balls 56 glide along the grooves 32. Due to the varying height provided by the profile 30, the bearing cases 52 will slide along the guide pins 44 to provide a variable door holding force.

Referring to FIG. 4, the bearing case 52 includes inner and outer faces 76, 78. The inner face 76 is spaced from the base 38 to provide a gap 80. Edges 84 of the bearing case 52 are arranged adjacent to the inner face 76 and are spaced apart from lateral lips 82 that extend from the base 38 parallel to the guide pins 44. A space 86 is provided between each of the edges 84 and the nearby lip 82. Thus, the bearing cases 52 do not contact the housing 18 during normal use.

When the door is extended to a fully open position, the stop 28 may engage the outer face 78 of the bearing cases 52, which causes the guide pins 44 to deflect and permit the inner face 76 to engage the base 38 and possibly the lips 82 if the bearing cases 52 move laterally. Deflection of the guide pins 44 allows to transfer load from the stop 28 through the bearing cases 52 and housing 18 to the door 12, which significantly increases the load carrying capability of the door check. The gap 80 and spaces 86 are relatively small, limiting the deflection of the guide pins 44.

Figure 2D:
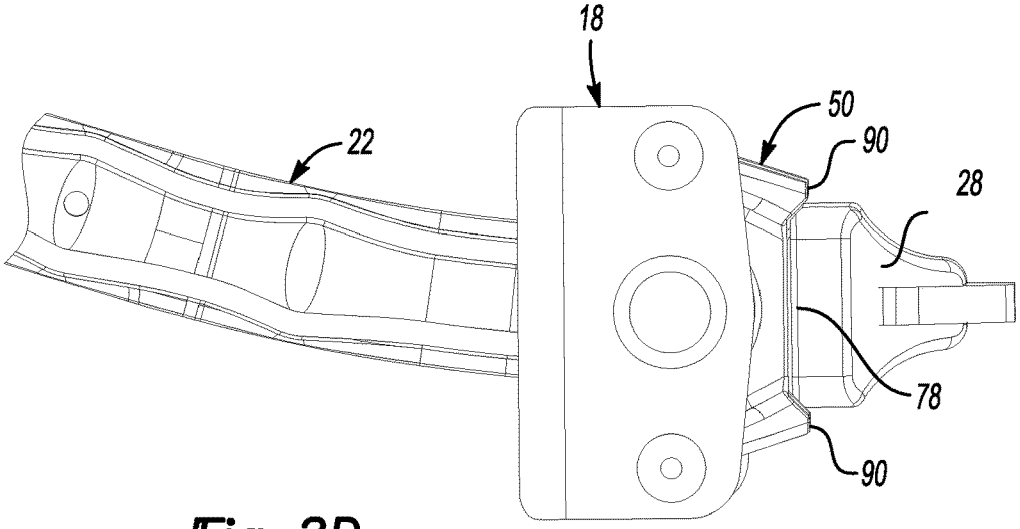
FIG. 2D is a plan view of a portion of the door checker shown in FIG. 2A with a check arm fully extended when the door is in a fully open position.

As shown in FIGS. 2A, 2B and 2D, the bearing cases 52 include spaced apart protrusions 90 adjacent to the outer face 78. The protrusions 90 laterally locate the stop 28 when the check arm 22 is fully extended (FIG. 2D) to prevent high loads, for example, 10 kN, on the stop 28 from pushing the stop 28 laterally off of the bearing cases 52.

Figure 5:
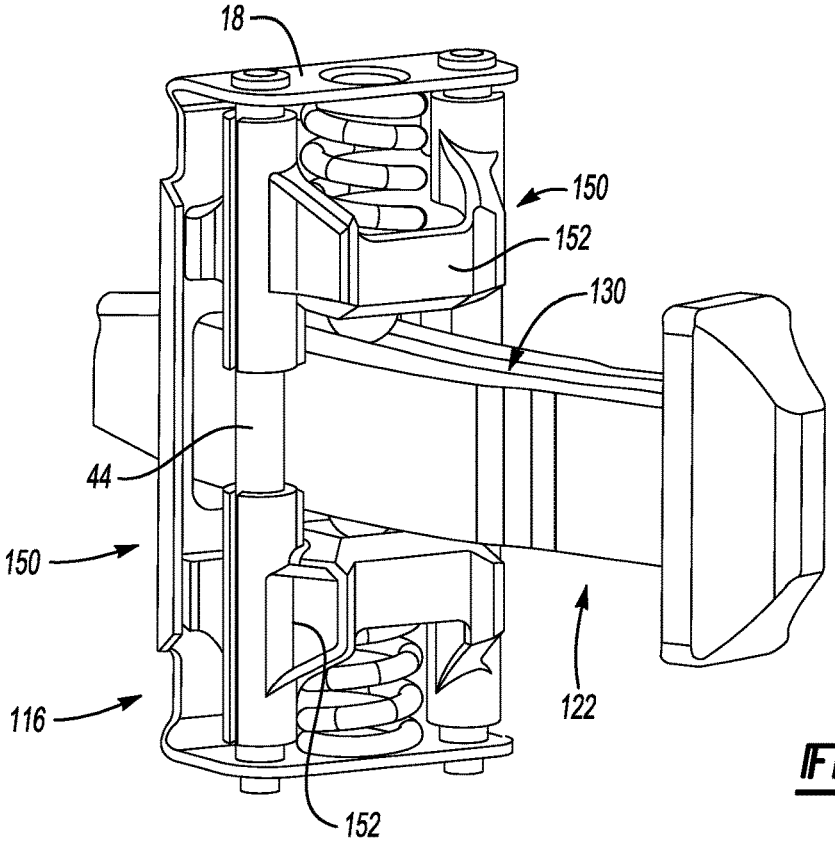
FIG. 5 is a perspective view of another door checker.
Figure 6:
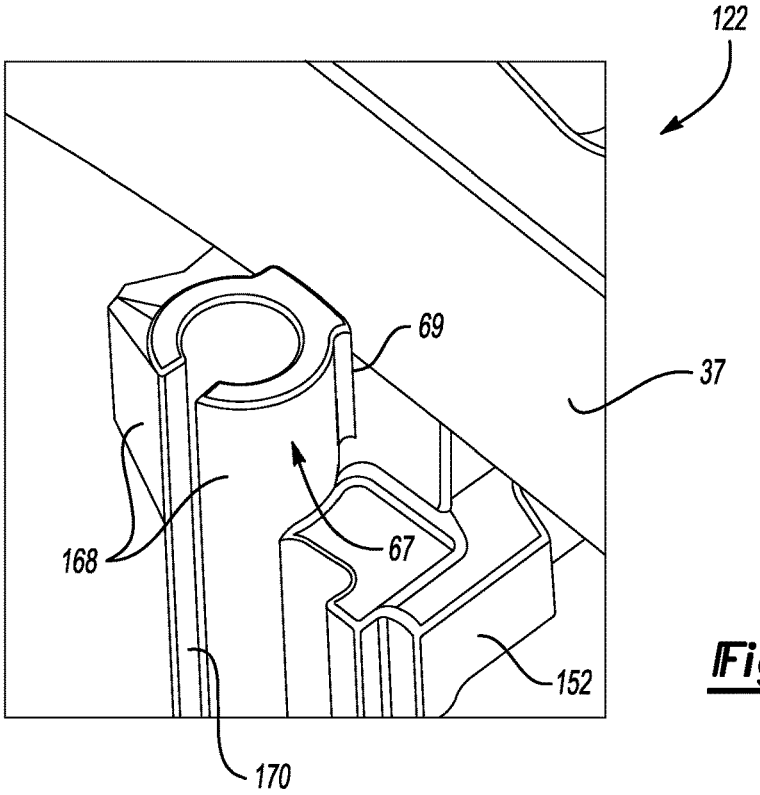
FIG. 6 is an enlarged perspective view of one bearing case engaging a check arm.
Figure 7:
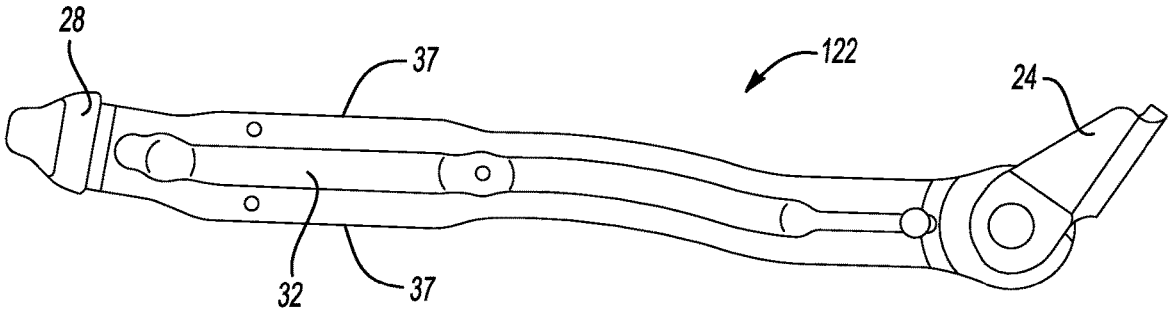
FIG. 7 is a plan view of the check arm shown in FIG. 6.

Another example door checker 116 is illustrated in FIGS. 5-7. The door checker 116 is similar to the door checker 16 shown in FIGS. 1-4, except different bearing members 150 and a different check arm 122 are used to provide an additional variable door holding force to that provided by the profile 130. In the example illustrated in FIGS. 5-7, each of the bearing members 150 is provided by a bearing case 152. A portion of the bearing case 152 is provided by a sleeve 67 (e.g., one sleeve on each lateral side of each bearing case) that extends to a region adjacent to lateral sides 37 of the check arm 122. The sleeves 67, which provide the curved walls 168 separated by the elongated slot 170, include a friction surface 69 adjacent to the lateral sides 37. The bearing members 150 transfer load via the sleeve 67 from the check arm 122 to the guide pins 44, which deflect and provide the additional variable door holding force.

As illustrated in FIG. 7, the lateral sides 37 define a width that varies along a length of the check arm 122. The position of the check arm in relation to the friction surface 69 corresponds to various door opening positions. The bearing member 150 selectively engages the check arm 122 based upon a sliding position of the check arm 122 relative to the housing 18. In this manner, this additional variable door holding force is provided by the load exerted from the deflected guide pins 44 onto the lateral sides 37, pinching the check arm 122 with varying degrees of force based upon a position of the check arm along its length (see, e.g., FIG. 10).

FIGS. 8A-9C depict another example door checker 216. The door checker 216 includes a housing 118 that may be constructed from a molded plastic to provide a lighter door checker. In such a configuration, the lips 182 may be extended to provide additional structural support to the opposing flanges 142.

Figure 8A:
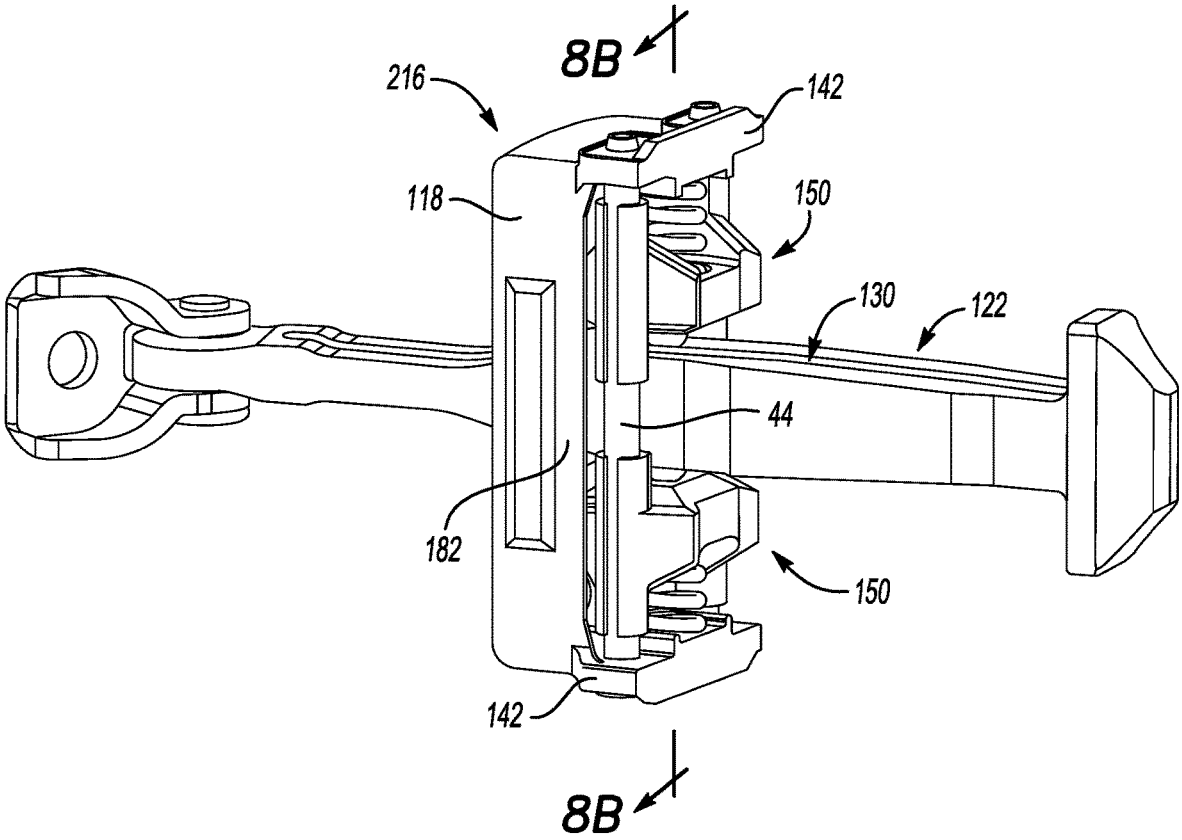
FIG. 8A is a perspective view of another example door checker in a first position.
Figure 8B:
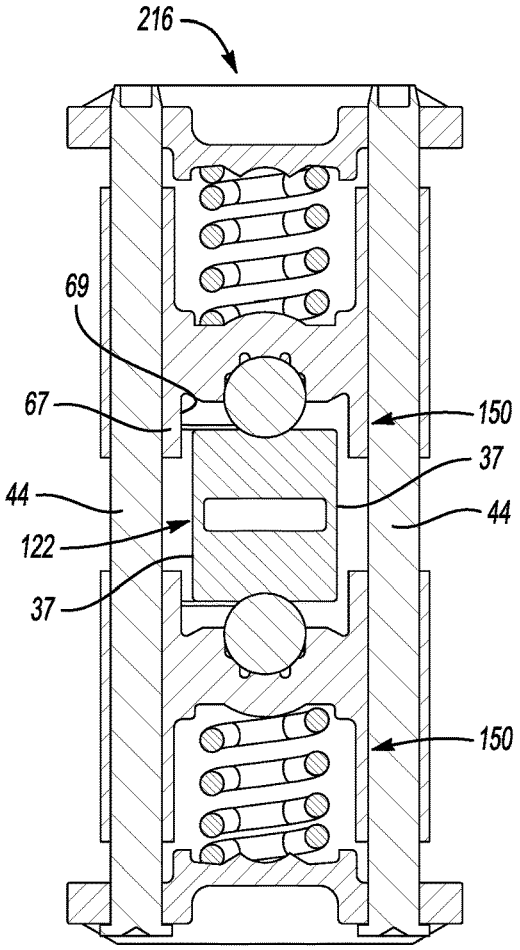
FIG. 8B is a cross-sectional view of the door checker of FIG. 8A taken along line 8B-8B.

The sleeves 67 are spaced from the lateral sides 37 in a first position, shown in FIGS. 8A and 8B, such that no additional variable door holding force is used to supplement the holding force provided by the engagement of the bearing members 150 with the profiles 130.

Figure 9A:
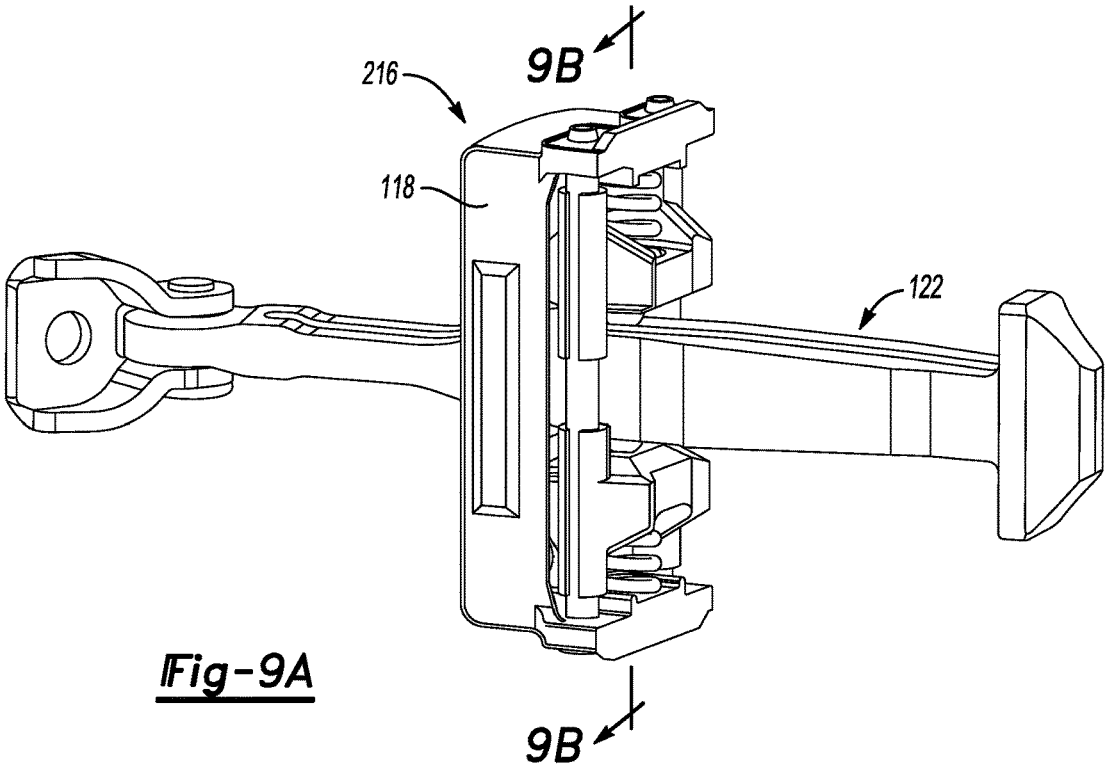
FIG. 9A is a perspective view of the door checker shown in FIG. 8A, but in a second position.
Figure 9B:
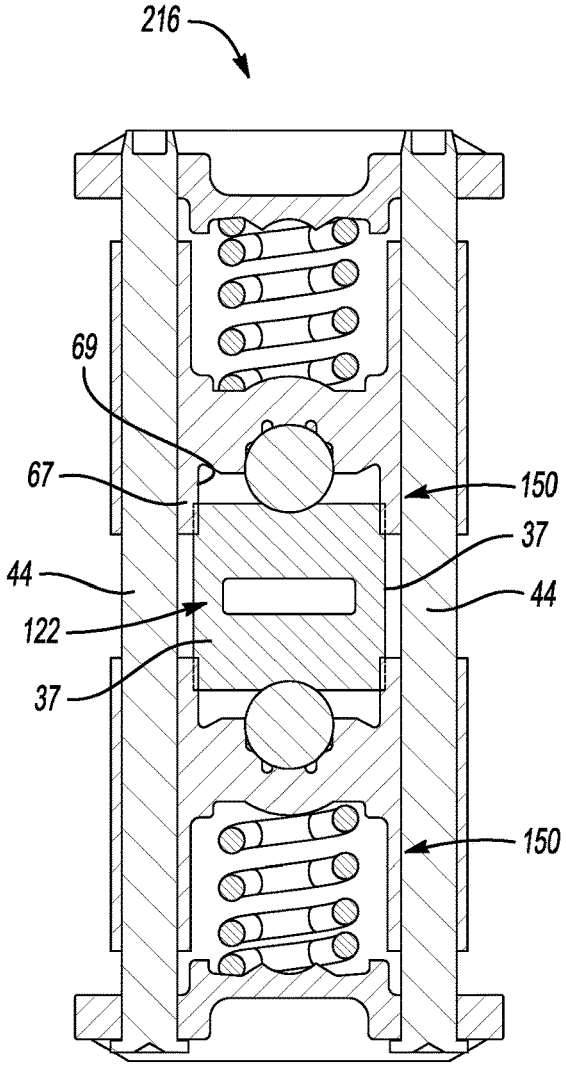
FIG. 9B is a cross-sectional view of the door checker of FIG. 9A taken along line 9B-9B.
Figure 9C:
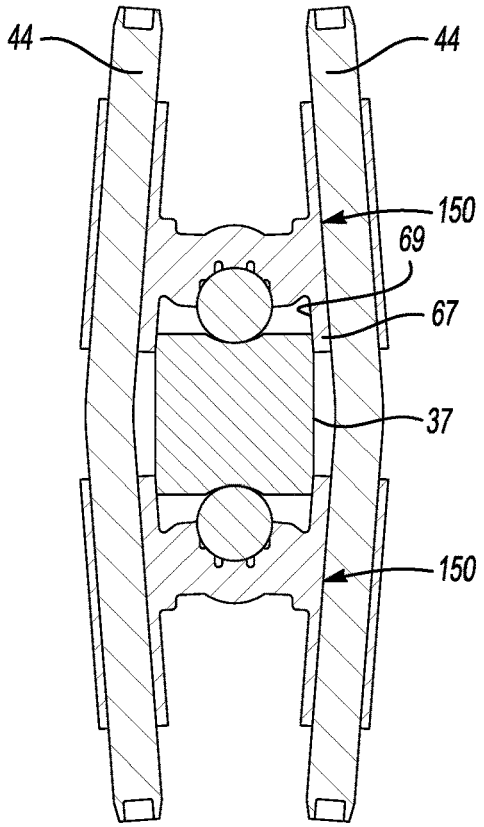
FIG. 9C is an exaggerated elevational view of the bearing case and guide pins in the second position.

Referring to FIGS. 9A-9C, a second position is illustrated in which the sleeves 67 engage the lateral sides 37 and deflect the guide pins 44, which is shown in exaggerated form in FIG. 9C. In this manner, the guide pins 44 deflect in response to a load that creates a supplemental variable door holding force to the variable holding force provided from the engagement of the bearing members 150 with the profiles 130.

Figure 10:
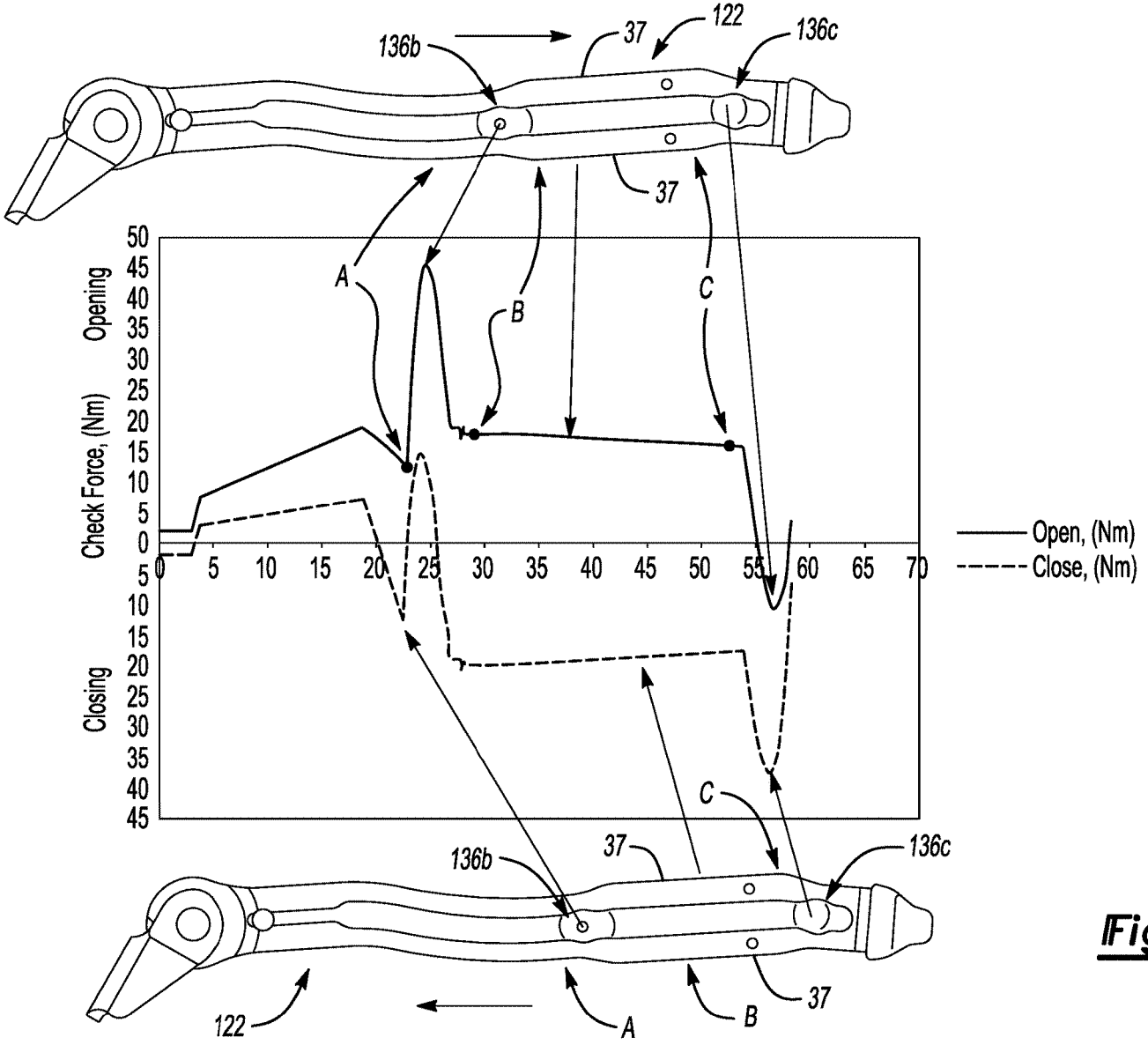
FIG. 10 is a graph depicting check force versus door angle when opening and closing a door.

One example check force curve is shown in FIG. 10 for various door opening and door closing angles for the door checker 216. The friction zones provided between positions B (shown in FIGS. 9A-9C) and C correspond to the additional variable door holding force provided by the engagement between the sleeves 67 and the lateral sides 37. Position A corresponds to the first position shown in FIGS. 8A and 8B where the sleeves 67 are spaced from the lateral sides 37.

The disclosed door checkers 16, 116 and 216 each provide a robust design that is lighter weight than prior door checker designs.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. A door checker comprising:

a housing which includes a base from which first and second opposing flanges extend;

first and second guide pins spaced apart from one another and interconnected to the first and second flanges, the first and second guide pins configured to deflect in response to a load;

a check arm which extends through the base and is arranged between the first and second guide pins, the check arm configured to move relative to the housing and including a profile that corresponds to a variable door holding force;

a bearing member arranged on one side of the check arm wherein the bearing member coacts with the profile and is supported on the first and second guide pins and is configured to slide thereon in response to movement of the check arm relative to the bearing member, and wherein the bearing member transfers the load from the check arm to the first and second guide pins; and wherein a portion of the bearing member selectively engages the check arm based upon a sliding position of the check arm relative to the housing, the variable holding force is a first variable door holding force, and the portions provided by lateral sides define a width that varies along a length of the check arm, and a second variable door holding force is provided between the bearing member and the lateral sides based upon a position along the length.

2. The door checker according to claim 1, wherein the bearing member includes a bearing case that has first and second sleeves that respectively receive the first and second guide pins, the sleeves extend to a region adjacent to the lateral sides, the first and second sleeves are spaced from the lateral sides with the check arm in the position corresponding to a first position, and the sleeves engage the lateral sides and deflect the first and second guide pins with the check arm in the position corresponding to a second position to generate the load.

3. The door checker according to claim 2, wherein the sleeves engage the first and second lateral sides and deflect the first and second guide pins with the check arm in another position that is different than the second position, the check arm deflecting the first and second guide pins such that the load is a first load in the second position, and the check arm deflecting the first and second guide pins such that the load is a second load in the other position that is different than the first load.

4. The door checker according to claim 2, wherein the first and second sleeves include first and second elongated slots respectively along their lengths, the first and second slots respectively receive the first and second guide pins, and the first and second sleeves have an arcuate cross-section and are open on one side.

5. The door checker according to claim 1, comprising another bearing member arranged on another side of the check arm, wherein the other bearing member coacts with another profile on the other side of the check arm, wherein the profiles have a variable height, and the bearing members are configured to slide along the first and second guide pins as the bearing members coact with the profiles.

6. The door checker according to claim 4, wherein the bearing member includes a bearing case with an aperture within which a ball is arranged, the ball engages the profile, and a spring is arranged between the first flange and the bearing case and is configured to urge the ball into engagement with the profile to provide the variable door holding force.

7. The door checker according to claim 6, wherein the bearing case is configured to slide on the first and second guide pins as the ball slides in the groove.

8. The door checker according to claim 1, wherein the bearing member includes a bearing case slidable on the first and second guide pins during operation, and comprising a clevis pivotally attached to one end of the check arm, and a stop at the other end of the check arm on a side of the bearing case with an outer face having spaced apart protrusions configured to laterally locate the stop with the check arm in a fully extended position, wherein the bearing case includes an inner face spaced from the base in a first position, and the guide pins are configured to flex thereby transferring the load and permitting the inner face to engage the base in another position in which the stop engages the outer face.

9. The door checker according to claim 8, wherein the base includes spaced apart lips, and the bearing case includes opposing edges adjoining the inner face near the lips, the lips configured to arrest lateral motion of the bearing case with respect to the housing in the other position.

10. The door checker according to claim 1, wherein each of the first and second guide pins includes swaged ends securing the first and second guide pins to the first and second flanges.

11. The door checker according to claim 10, wherein the housing is plastic.

12. A method of holding a door in a desired open position, the method comprising the steps of:

sliding a check arm relative to a bearing member which selectively engages the check arm based upon a sliding position of the check arm relative to a housing and transfers a load from the check arm to first and second guide pins to provide a first variable door holding force;

sliding the bearing member along the first and second guide pins in response to the check arm sliding step; and engaging lateral sides of the check arm which define a width that varies along a length of the check arm with a portion of the bearing member in response to the check arm sliding step to provide a second variable door holding force between the bearing member and the lateral sides in addition to the first variable door holding force based upon the position along the length.

13. The method according to claim 12, wherein a portion of the bearing member selectively engages the check arm during the check arm sliding step, the portion is spaced from the check arm at a first check arm position, and the portion engages the check arm at a second check arm position.

14. The method according to claim 13, wherein the portion is provided by first and second sleeves that are slidably supported on the first and second guide pins.

15. The method according to claim 14, wherein the check arm is arranged between a pair of bearing members, and the bearing members move relative to one another during the bearing member sliding step.

16. The method according to claim 12, wherein the bearing member includes a bearing case having a ball that rides along a groove in the check arm that provides a profile.

17. The method according to claim 12, comprising a housing supporting the first and second guide pins that support the bearing case for sliding movement in response to the check arm sliding step.

18. The method according to claim 12, comprising the step of engaging the bearing case with a check arm stop which deflects the guide pin and moves the bearing case into engagement with the housing.

* * * * *